US010493758B2

(12) United States Patent
Giusti et al.

(10) Patent No.: US 10,493,758 B2
(45) Date of Patent: Dec. 3, 2019

(54) FLUID EJECTION DEVICE AND PRINTHEAD

(71) Applicants: STMICROELECTRONICS S.R.L., Agrate Brianza (IT); STMICROELECTRONICS, INC., Coppell, TX (US)

(72) Inventors: Domenico Giusti, Monza (IT); Marco Ferrera, Concorezzo (IT); Carlo Luigi Prelini, Seveso (IT); Simon Dodd, West Linn, OR (US)

(73) Assignees: STMICROELECTRONICS S.R.L., Agrate Brianza (IT); STMICROELECTRONICS, INC., Coppell, TX (US)

( * ) Notice: Subject to any disclaimer, the term of this patent is extended or adjusted under 35 U.S.C. 154(b) by 0 days.

(21) Appl. No.: 15/884,186

(22) Filed: Jan. 30, 2018

(65) Prior Publication Data

US 2018/0281402 A1 Oct. 4, 2018

(30) Foreign Application Priority Data

Mar. 28, 2017 (IT) ..... 102017000034134

(51) Int. Cl.
*B41J 2/14* (2006.01)
*B41J 2/18* (2006.01)
(Continued)

(52) U.S. Cl.
CPC ..... *B41J 2/14* (2013.01); *B05B 1/02* (2013.01); *B41J 2/055* (2013.01); *B41J 2/14233* (2013.01);
(Continued)

(58) Field of Classification Search
CPC . B41J 2/14; B41J 2/1631; B41J 2/1629; B41J 2/1628; B41J 2/1626; B41J 2/1623;
(Continued)

(56) References Cited

U.S. PATENT DOCUMENTS 7,294,536 B2 11/2007 Villa et al.
7,537,319 B2 5/2009 Jung et al.
(Continued)

FOREIGN PATENT DOCUMENTS

CN 101125480 A 2/2008
CN 102344111 A 2/2012
CN 105711258 A 6/2016
JP 2010-188547 A 9/2010

*Primary Examiner* — Bradley W Thies
(74) *Attorney, Agent, or Firm* — Seed Intellectual Property Law Group LLP

(57) ABSTRACT

Ejection device for fluid, comprising a solid body including: first semiconductor body including a chamber for containing the fluid, an ejection nozzle in fluid connection with the chamber, and an actuator operatively connected to the chamber to generate, in use, one or more pressure waves in the fluid such as to cause ejection of the fluid from the ejection nozzle; and a second semiconductor body including a channel for feeding the fluid to the chamber, coupled to the first semiconductor body, in such a way that the channel is in fluid connection with the chamber. The second semiconductor body integrates a damping cavity over which extends a damping membrane, the damping cavity and the damping membrane extending laterally to the channel for feeding the fluid.

20 Claims, 10 Drawing Sheets

(51) Int. Cl.
*B41J 2/055* (2006.01)
*B41J 2/16* (2006.01)
*B05B 1/02* (2006.01)

(52) U.S. Cl.
CPC ..... *B41J 2/161* (2013.01); *B41J 2/1623* (2013.01); *B41J 2/1626* (2013.01); *B41J 2/1628* (2013.01); *B41J 2/1629* (2013.01); *B41J 2/1631* (2013.01); *B41J 2/18* (2013.01); *B41J 2002/14346* (2013.01); *B41J 2002/14403* (2013.01); *B41J 2002/14419* (2013.01); *B41J 2202/12* (2013.01)

(58) Field of Classification Search
CPC ..... B41J 2/161; B41J 2/14233; B41J 2/055; B41J 2002/14346; B41J 2002/14403; B41J 2002/14419; B05B 1/02
See application file for complete search history.

(56) References Cited

U.S. PATENT DOCUMENTS

| | | | | |
|---|---|---|---|---|
| 7,594,714 | B2 | 9/2009 | Katayama | |
| 8,633,553 | B2 | 1/2014 | Ferrera et al. | |
| 2004/0056937 | A1 | 3/2004 | Ito | |
| 2004/0096964 | A1 | 5/2004 | Mastromattteo et al. | |
| 2006/0181581 | A1 | 8/2006 | Jung et al. | |
| 2007/0052780 | A1 | 3/2007 | Mizutani et al. | |
| 2008/0261345 | A1 | 10/2008 | Villa et al. | |
| 2009/0102907 | A1 | 4/2009 | Yamanaka et al. | |
| 2012/0018819 | A1 | 1/2012 | Ferrera et al. | |
| 2013/0115724 | A1* | 5/2013 | Kearl | B41J 2/1603 438/21 |
| 2014/0313264 | A1 | 10/2014 | Cattaneo et al. | |
| 2015/0077469 | A1* | 3/2015 | Kohda | B41J 2/145 347/40 |

* cited by examiner

FLUID EJECTION DEVICE AND PRINTHEAD

BACKGROUND

Technical Field

The present disclosure relates to a fluid ejection device with an element for reducing cross disturbances ("crosstalk"), to a printhead including the ejection device, to a printer including the printhead and to a method for manufacturing the fluid ejection device.

Description of the Related Art

In the current state of the art multiple types of fluid ejection device are known, in particular "inkjet" devices for printing applications.

Similar devices, with suitable modifications, can also be used for the emission of various types of fluids, for example in the sphere of applications in the biological or biomedical field, for local ejection of biological material (e.g., DNA) during the manufacturing of sensors for biological analyses.

An example of an ejector element with piezoelectric actuation of known type is shown in FIG. 1 and indicated with the reference number 1. A plurality of ejector elements 1 form, at least in part, a printing device ("printhead").

With reference to FIG. 1, a first wafer or plate 2, e.g., of semiconductor material or metal, is processed to form one or more piezoelectric actuators 3 on it, capable of causing a deflection of a membrane 7 extending partially suspended above one or more chambers 10, suitable for temporary containment of a fluid 6 to be expelled during use.

A second wafer or plate 4, of semiconductor material, is processed so as to form one or more containment chambers 5 for the piezoelectric actuators 3, so as to isolate, in use, the piezoelectric actuators 3 from the fluid 6 to be expelled.

A third wafer or plate 12, of semiconductor material, configured for being arranged above the second plate 4, is processed so as to form expulsion holes 13 for the fluid 6 ("outlet" holes).

A fourth wafer or plate 8, of semiconductor material, configured to be arranged below the second plate 4, is processed so as to form one or more input holes ("inlet" holes) 9*a* for the fluid 6 into the chamber 10, and one or more recirculating holes 9*b* for the fluid 6, which form a route for the recirculation of the fluid 6 not ejected.

Afterwards, plates 2, 4, 8 and 12 are assembled together by means of soldering interface regions ("bonding regions") or gluing interface regions ("gluing regions") or adhesive interface regions ("adhesive regions"), or Au frit, or glass frit, or by means of polymeric bonding. These regions are generically indicated in FIG. 1 by the reference number 15.

In addition, the printing device 1 is equipped with a collector (better known as a "manifold") 16 which has the function of feeding the fluid 6 into the chamber 10. The manifold 16 comprises a feed channel 17, operatively coupled to a tank ("reservoir"), not shown, from which it receives, during use, the fluid 6 which is fed to the chamber 10 via the inlet hole 9*a*. Furthermore, the manifold 16 comprises a recirculating channel 18 by means of which the fluid 6 that was not emitted through the expulsion hole 13 is fed back into the reservoir. The reservoir is shared between a plurality of printing devices of the type shown in FIG. 1.

To allow the ejection of the fluid 6 through the outlet hole 13, the piezoelectric actuator 3 is controlled in such a way as to generate a deflection of the membrane 7 towards the inner part of the chamber 10. This deflection causes a movement of the fluid 6 through the outlet hole 13 for the controlled expulsion of a drop of fluid towards the outer part of the printing device 1. However, the pressure wave applied to the fluid 6 is further propagated, both along the recirculating channel 18, and along the feed channel 17, returning towards the manifold 16 and, from here, towards the reservoir. Pressure waves are thus generated, during use, towards the reservoir, and within the fluid contained in the reservoir itself, which causes a disturbance during the operative steps (loading of the fluid towards chamber 10 and recirculation of the fluid towards the reservoir) of other printing devices sharing the same reservoir. It is common to refer to this type of disturbances as "crosstalk."

The manifold 16 is structured so as to minimize the propagation of pressure disturbances between chambers 10 of mutually adjacent ejector elements 1.

To this end, the manifold 16 has a first attenuation membrane 19*a*, suspended over a first cavity 20*a*, directly facing the inlet hole 9*a*; and a second attenuation membrane 19*b*, suspended over a second cavity 20*b*, directly facing the recirculation hole 9*b*.

In use, the first and the second membranes 19*a*, 19*b* are deflected in response to the pressure waves which are generated in fluid 6 during the oscillation of membrane 7, and which propagate from here towards the underlying reservoir. In this way, the first and second membranes 19*a*, 19*b*, by absorbing at least in part the pressure force, reduce the impact of said force both on the internal walls of the fourth plate 8, and on the liquid contained in the reservoir, limiting its propagation towards the other ejector elements 1 of the printing device. Therefore, the presence of membranes 19*a*, 19*b* cooperates in ensuring that each drop ejected by an ejector element 1 is not influenced by the operation of other ejector elements 1. The manifold 16 also comprises an inlet filter 21*a* located at the entrance of the feed channel 17 and configured to trap undesired particulates, and a recirculation filter 21*b* located at the outlet of the recirculation channel 18. Filters are typically made of stainless steel or a polymer and are mechanically attached or glued to the printhead. The filters can be very expensive and the mechanical assembly further adds cost and complexity to the printhead.

Moreover, the assembling process of the manifold 16 requires high accuracy and precision in aligning the feed channel 17 with the inlet hole 9*a* and in aligning the recirculation channel 18 with the recirculation hole 9*b*, ensuring that there are no air leaks which would irremediably compromise the functionality of the ejector element. This process is, therefore, onerous and subject to manufacturing errors.

BRIEF SUMMARY

One or more embodiments are directed to a fluid ejection device having an element for reducing crossing disturbances ("crosstalk"), a printhead including the ejection device, a printer including the printhead and a method for manufacturing the fluid ejection device. Other embodiments are directed to a manufacturing process for a fluid ejection device based on piezoelectric technology with an integrated crosstalk-attenuation element. Furthermore, the present disclosure relates to the application of said fluid ejection device to a printhead and to a printer including said printhead.

BRIEF DESCRIPTION OF THE SEVERAL VIEWS OF THE DRAWINGS

For a better understanding of the present disclosure, preferred embodiments thereof are now described, purely by way of non-limiting example, with reference to the attached drawings, in which.

DETAILED DESCRIPTION

Figure 1:
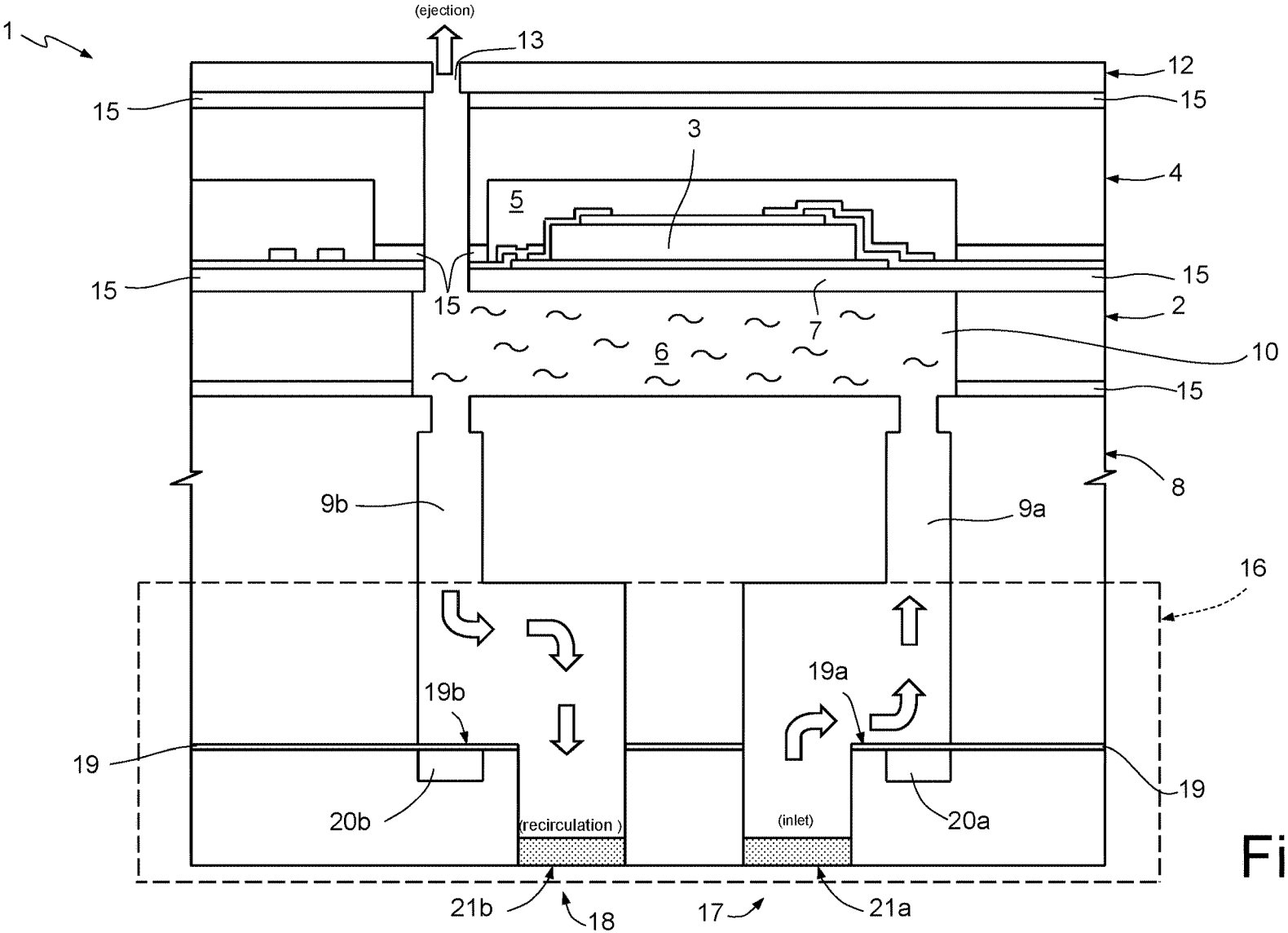
FIG. 1 shows a printing device with piezoelectric actuation with a collector region according to an embodiment of known type.
Figure 2:
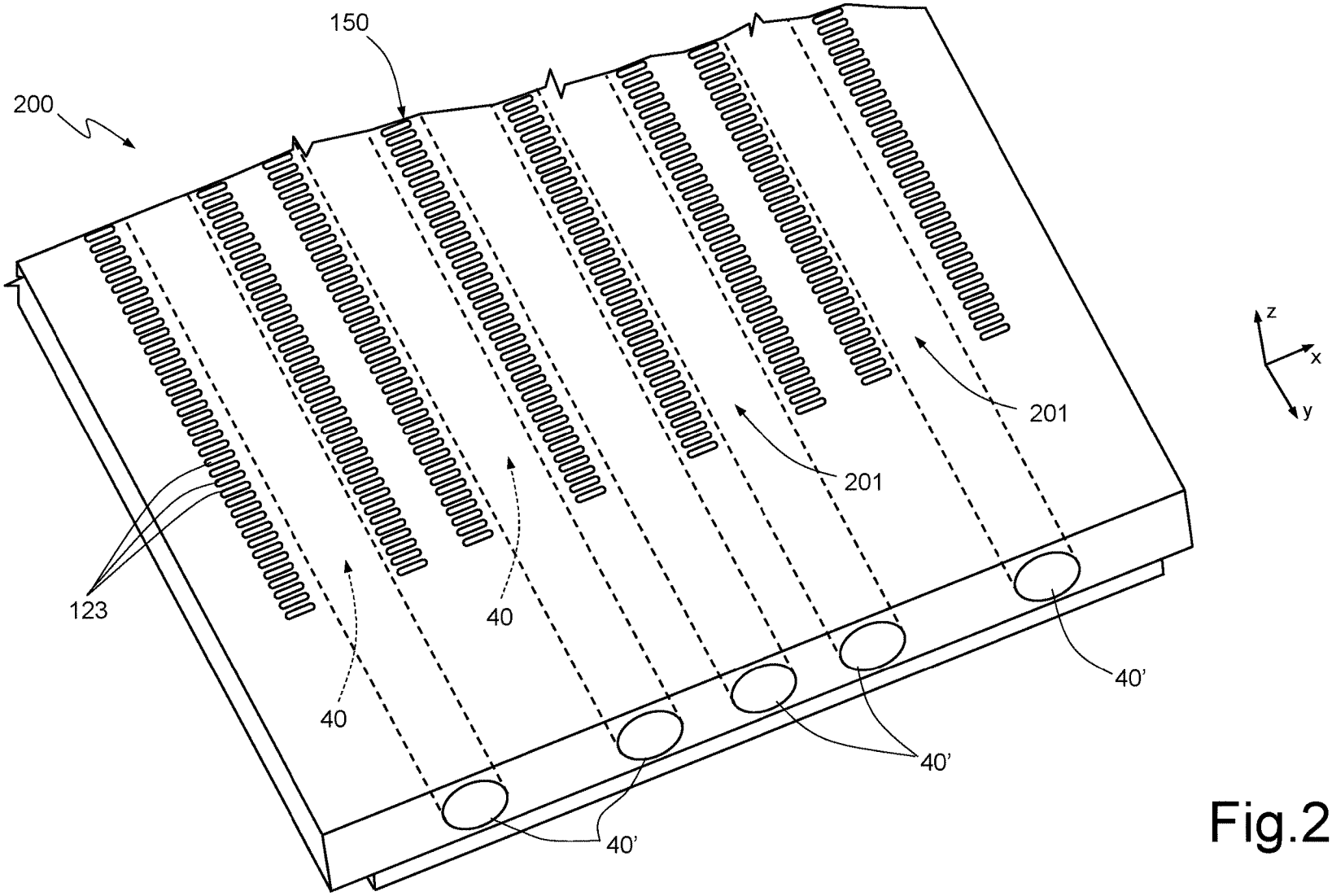
FIG. 2 shows in perspective and from above a printhead with piezoelectric actuation with an integrated damper according to an embodiment of the present disclosure.

FIG. 2 shows, in perspective and in a triaxial reference system X, Y, Z, a portion of a printing device 200 including a plurality of fluid ejection elements 150 according to an aspect of the present disclosure. Each fluid ejection device 150 includes an integrated damper 201 made up of a respective membrane extending over a respective buried cavity 40. FIG. 2 shows a plurality of buried cavities 40, extending, in plan view over plane XY, sidelong with inlet holes 123 of the fluid ejection devices 150. Inlet holes 123 are capable of being coupled to a manifold and, therefore, to a fluid reservoir, to receive the fluid that is to be ejected during use. Thus, a group of fluid ejection devices 150, aligned in the same direction parallel to axis Y, shares the same integrated attenuator 201. Each buried cavity 40 is fluidically connected to the external environment by means of a respective channel 40' which extends as a prolongation of cavity 40 along axis Y. The opening of channel 40' is carried out during a cutting step (separation or "dicing") of the printing device 200.

The manufacturing process and the mode of operation of each fluid ejection device 150 with the integrated attenuator 201 are described hereafter.

FIGS. 3-12 show, in transverse section view, steps of processing a "wafer" of semiconductor material 30 for forming the buried cavity 40, and, thus, the integrated attenuator 201 according to the present disclosure.

According to further embodiments, not disclosed in detail but apparent to skilled person, the wafer 30 may be, at least in part, of a material which is not a semiconductor, e.g., glass or germanium.

Figure 3:
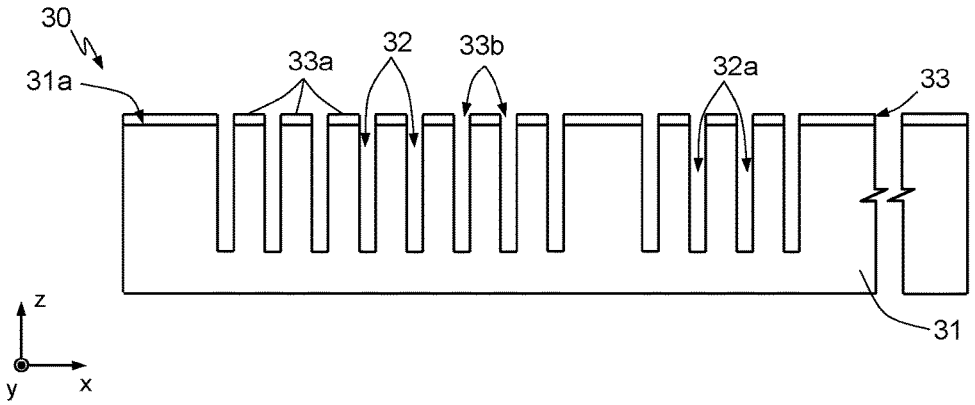
FIGS. 3-16 show, in a cross-section view, manufacturing steps of a fluid ejection element according to an aspect of the present disclosure, as an integrated acoustic damper according to one embodiment.

With reference to FIG. 3, the semiconductor wafer 30 is shown, including a substrate 31, in particular of silicon (e.g., single crystal), in an initial step of the manufacturing process which provides for the formation of a plurality of trenches 32 and 32*a*.

In particular, as better described below, the trenches 32 are formed at regions of the substrate 31 in which it is desired to form the buried cavity 40 for the integrated damper (shown in FIG. 7 at the end of the steps of its formation).

The trenches 32*a* are formed in regions of the substrate 31 in which it is desired to form an inlet region for a fluid to be ejected by the ejection device 150. The fluid inlet region includes, as better described in the following, the inlet hole 123 (capable of being coupled to a manifold and to a fluid reservoir) and an integrated filter for filtering any undesired particulate present in the fluid.

With reference to FIG. 3, above an upper surface 31*a* of the substrate 31, a mask 33 for photolithography is formed, for example of photoresist film.

Mask 33, in top view on plane XY, has a lattice conformation, for example honeycomb; FIG. 3 shows portions 33*a* of mask 33, connected to form said lattice, after the lithography and chemical etching steps to form trenches 32, 32*a*.

Trenches 32, 32*a*, having their principal extension along axis Z, are etched by an anisotropic chemical etching on substrate 31, starting from a front side of substrate 31. Considering, for example, a substrate 31 of a thickness of about 100-500 μm, trenches 32, 32*a* have a depth of about 80-400 μm. In general, the trenches extend into the substrate 31 as far as a distance, from a rear side of the substrate 31 (opposite to the front side), of about 20-100 μm.

Figure 4:
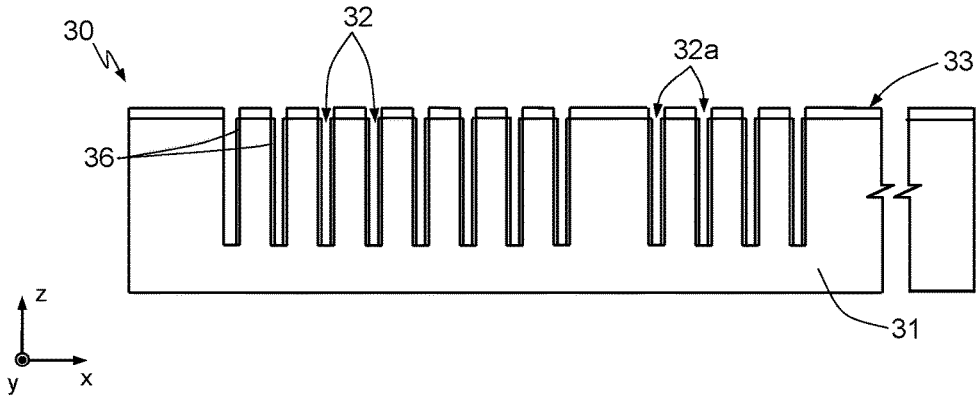

Subsequently, FIG. 4, still with mask 33 positioned over the upper surface 31*a* of the substrate 31, a deposition of silicon dioxide ($SiO_2$) or other dielectric material (such as, for example, silicon oxynitride or nitride) is carried out, in order to form spacers 36 on the lateral inside walls of trenches 32 and 32*a*. It is noted that any dielectric material formed on the bottom of the trenches 32, 32*a* is removed by anisotropic etching.

Figure 5:
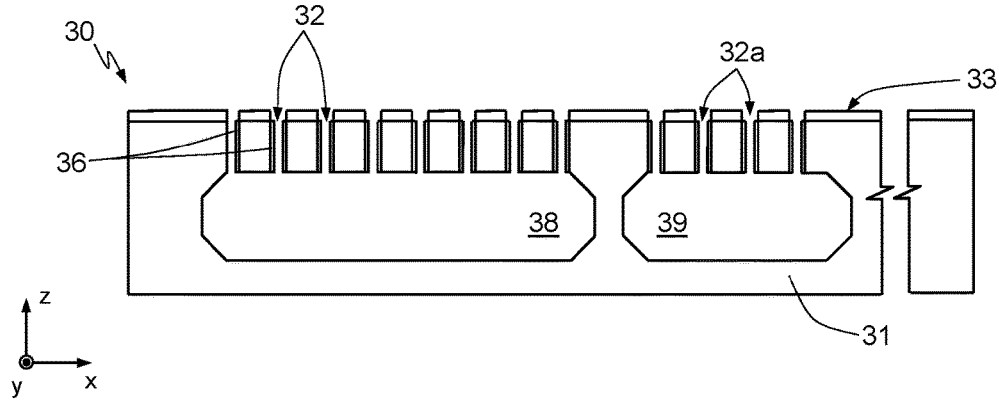

Subsequently, FIG. 5, a step of isotropic chemical etching is carried out, for example with the etching chemistry TMAH (tetramethylammonium hydroxide), so as to form a first and a second open cavity 38, 39, in fluidic communication with trenches 32, 32*a* respectively. In particular, the isotropic chemical etching erodes the portion of the substrate 31 below the trenches 32, 32*a*, both in the direction of depth Z (direction of principal extension of trenches 32, 32*a*) and in a lateral direction, transverse to said vertical direction (i.e., on plane XY). The extension on plane XY of the open cavities 38, 39 substantially corresponds to the extension, still on plane XY, of mask 33 previously formed over the substrate 31.

Figure 6:
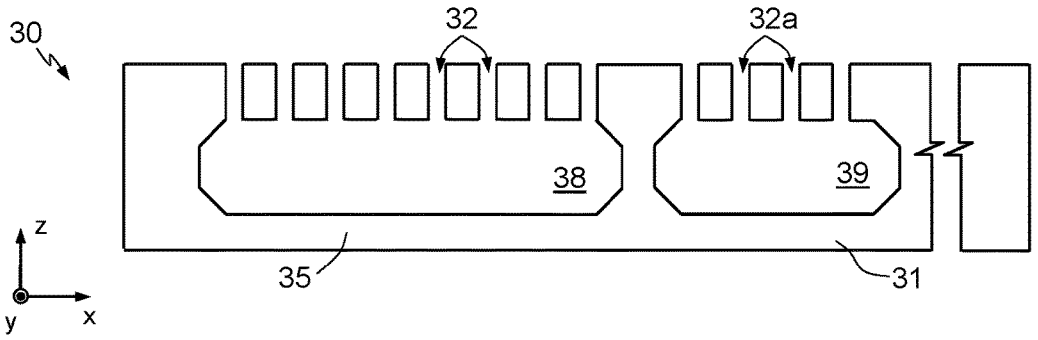

As shown in FIG. 6, mask 33 is removed from the upper surface 31*a* of the substrate 31 and the dielectric material 36 previously deposited on the walls of the trenches 32, 32*a* is also removed, for example by wet etching ("wet etching").

Figure 7:
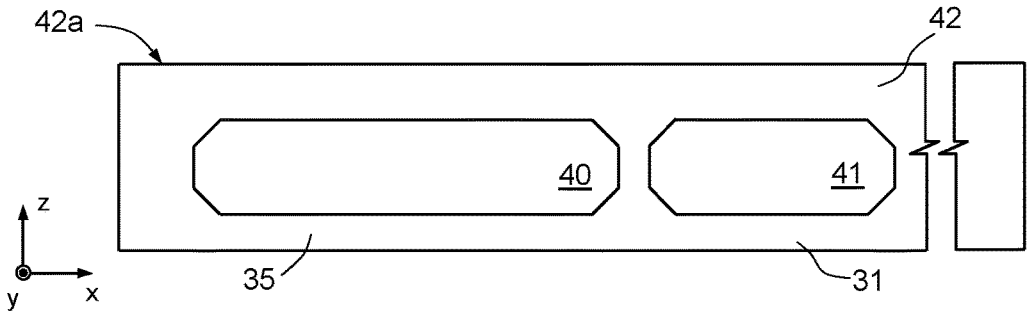

As shown in FIG. 7, a step of epitaxial growth of monocrystalline or polycrystalline silicon is carried out, preferably in a deoxidizing environment (typically, in an atmosphere with a high concentration of hydrogen, preferably in trichlorosilane, $SiHCl_3$), closing off trenches 32, 32*a* at the top. Optionally, a heat treatment ("annealing") step is performed, for example in a nitrogen ($N_2$) atmosphere, in particular at a temperature of about 1200° C.; the annealing step causes a migration of silicon atoms, which tend to move to lower energy positions thus completing the formation of the buried cavity 40 (at the region in which the trenches 32 extend) and of a buried cavity 41 (at the region in which the trenches 32*a* extend).

The buried cavities 40 and 41, at this step of manufacturing, are completely isolated from the external environment and contained within substrate 31 itself; above cavities 40 and 41 there extends a first surface layer 42, compact and uniform, consisting partly of epitaxially grown mono- or polycrystalline atoms and partly of silicon atoms which migrated during the previous annealing step, and having a thickness, for example, of between 1 μm and 300 μm.

Below the buried cavity 40 there extends a portion of substrate 31 which forms a membrane 35 suspended over the buried cavity 40. The membrane 35 has a thickness, measured along the direction of axis Z, of between 1 μm and 50 μm, in particular equal to 5 μm.

Figure 8:
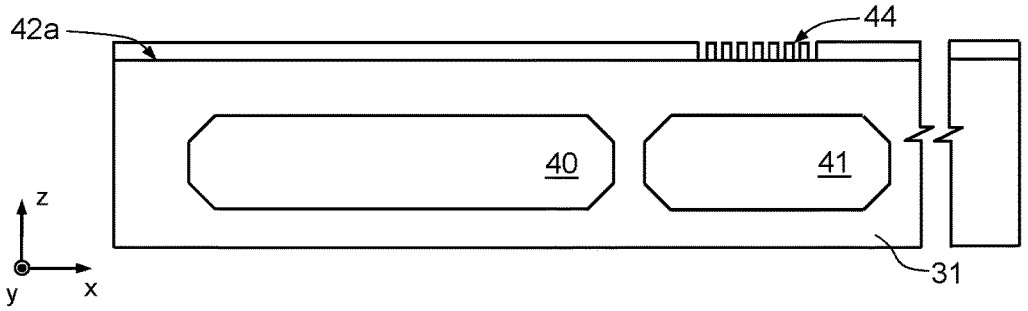

The process continues with steps for the formation of an integrated antiparticulate filter. To this end, over an upper surface 42*a* of the first surface layer 42, a mask of suitable shape (as better clarified below) is formed, utilized for performing a step of selective oxidization. In this way the structure of FIG. 8 is obtained, wherein on the upper surface 42*a* of the first surface layer 42 an etching mask 44 formed of silicon dioxide or other dielectric material is present. In particular, the etching mask 44 has a lattice structure defining apertures 44*a* at the buried cavity 41. Apertures 44*a* are spaced at a regular distance, of between 0.5 μm and 50 μm along direction X. The same spacing is present along direction Y. Alternatively, apertures 44*a* can have a different extension along axes X and Y. As said before, etching mask 44 has the aforesaid apertures 44*a* solely at the second buried cavity 41; in the remaining part of its extension, etching mask 44 does not have other empty spaces and is, therefore, continuous.

Figure 9:
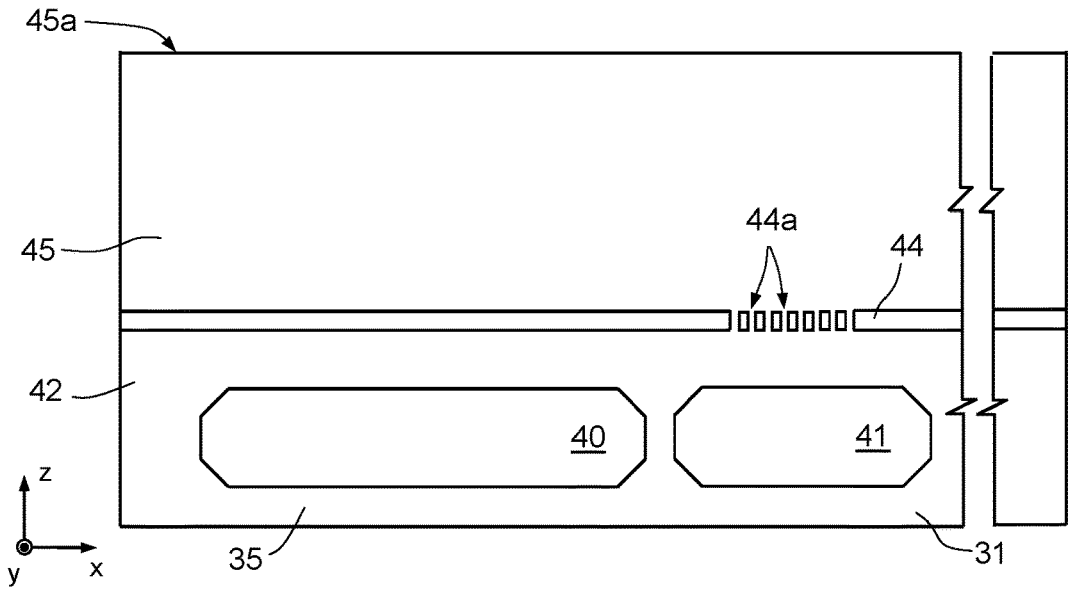

As shown in FIG. 9, the process continues with a step of epitaxial growth of monocrystalline or polycrystalline silicon, following which a second surface layer 45 is formed above the first surface layer 42. Consequently, etching mask 44 results interposed between the first and the second surface layer 42, 45 respectively.

Figure 10:
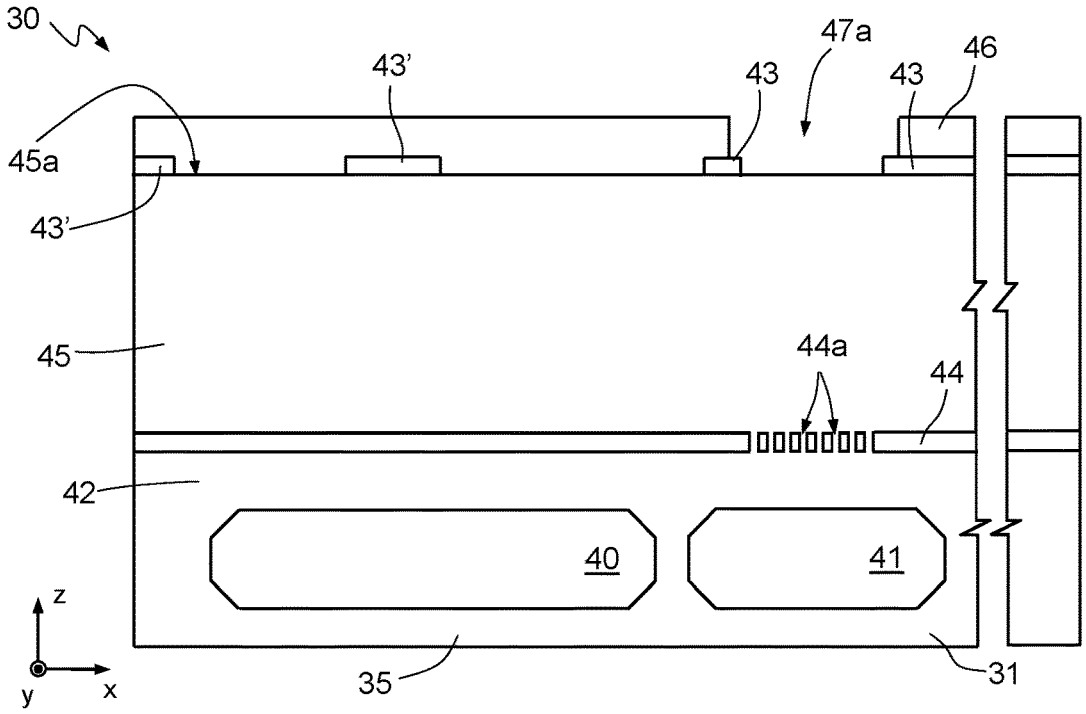

As shown in FIG. 10, on top of an upper surface 45*a* of the second surface layer 45, regions of inlet mask 43 and regions of edge mask 43' are formed.

The regions of edge mask 43' are suitable for delimiting a portion of the second surface layer 45 that, in subsequent steps, will operate as a containment chamber for a piezoelectric actuator. The regions of inlet mask 43 are suitable for delimiting a surface portion 47*a* of the second surface layer 45 in correspondence to which, in subsequent steps, part of the fluid inlet channel will be formed.

A photolithographic mask 46 is formed, over the upper surface 45*a* of the second surface layer 45, which leaves the surface portion 47*a* adjacent to the apertures 44*a* of the etching mask 44 uncovered (i.e., aligned with the apertures 44*a* along axis Z).

Figure 11:
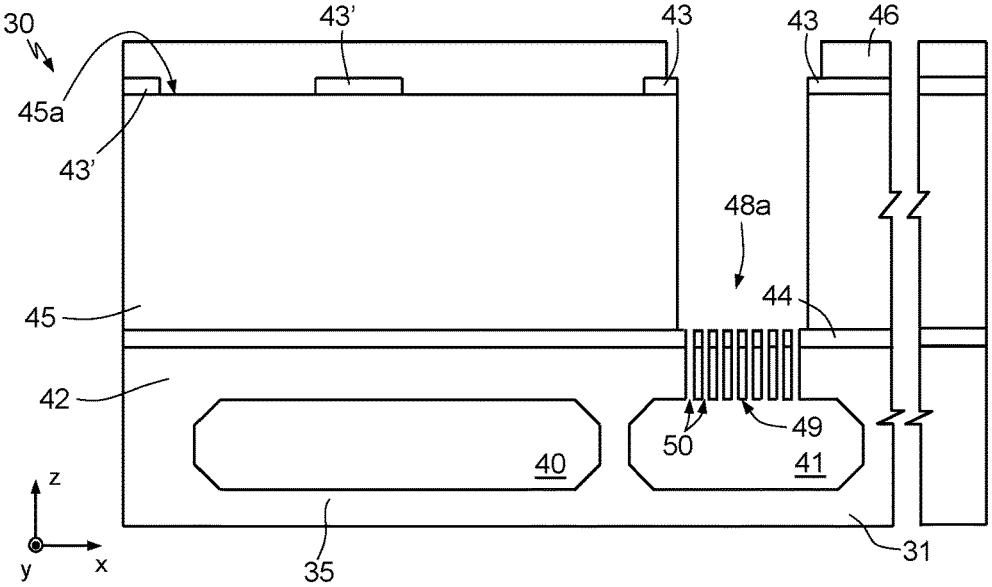

A deep etching step of anisotropic type on the silicon is carried out, FIG. 11, and with an etching depth such that it involves the entire thickness of the second surface layer 45 and that of the first surface layer 42. In particular, the etching removes the portions of the first surface layer 42 which are not protected by the mask 44. The etching mask 44 in fact works as a screen for the etching and ensures that the underlying portions of silicon remain substantially intact, in fact replicating the lattice structure and conformation, on plan, of the etching mask 44 itself, and consequently forming a filter element 49. Thus, above the second buried cavity 41, the filter element 49 of the type integrated into the silicon is formed.

The filter element 49 is thus made up of a lattice structure with vertical extension (with a height substantially equal to the thickness of the first surface layer 42), defining on its interior a plurality of apertures 50, in order to enable the passage of the fluid through them and to trap undesired particles (having dimensions not compatible with the dimensions of the apertures 50); between adjacent apertures 50 there are vertical walls or plates.

In particular, the deep etching on the silicon through the lithographic mask 46 leads to the creation of a duct 48*a* which crosses the second surface layer 45 through its entire thickness and reaches the second buried cavity 41 through the filter element 49 (and vice versa). The filter element 49 is located so as to be separated from the upper surface 45*a* of the second surface layer 45 by the thickness of the second surface layer 45 itself, and interposed between duct 48*a* and buried cavity 41.

The etch step which leads to the formation of duct 48*a* in fluidic communication with the second buried cavity 41 automatically leads and at the same time to the formation of filter element 49 which is connected to the same access duct 48*a*, due to the previous formation of the etching mask 44 in an appropriate position and configuration; in particular, the filter element 49 is formed directly over the second buried cavity 41, which is integrated into the semiconductor material of which the first surface layer 42 is formed.

Figure 12:
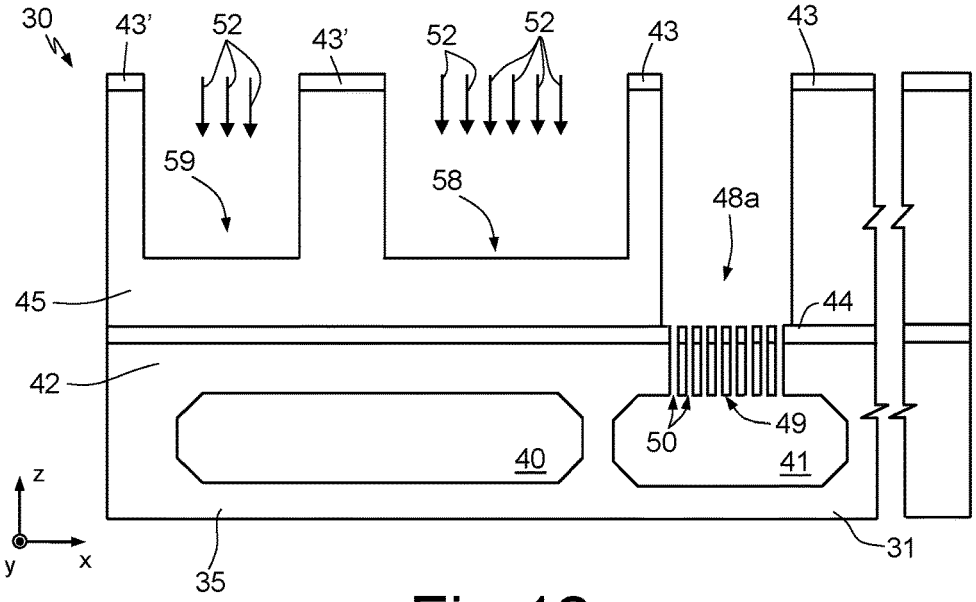

The process ends, FIG. 12, with a removing step of the photolithographic mask 46, and a subsequent etch, indicated by the arrows 52, for the purpose of completing the formation of the wafer 30 forming a housing 58 for the piezoelectric actuator (an actuator 80 is described with reference to FIG. 13) and a housing for electrical contacts 59, as is better explained below.

At the end of these removal steps, there is obtained a micromechanical structure including the membrane 35 suspended over the buried cavity 40, whose function is as an integrated damper to reduce the crosstalk; and the buried cavity 41 communicating with duct 48*a* through the filter element 49. As it has been said, this filter element 49 is capable of trapping particles, impurities and/or contaminants coming from the external reservoir (not shown here) during the feeding of the fluid to be ejected.

Both buried cavities 40, 41 and the filter element 49 are integrated into the same monolithic body (which, according to an aspect of the present disclosure, is of semiconductor material).

It should furthermore be emphasized that:

- the design or pattern of the etching mask 44, once the process is completed, determines the corresponding filtering pattern of the filter element 49; and
- the position of the etching mask 44 itself with respect to the second buried cavity 41 determines the corresponding position of the filter element 49, and, therefore, its function with respect to the filtering of impurities coming from outside, through the cavity and into the containment chamber 130.

The process continues with the manufacturing steps to complete the formation of the fluid ejection device.

Figure 13:
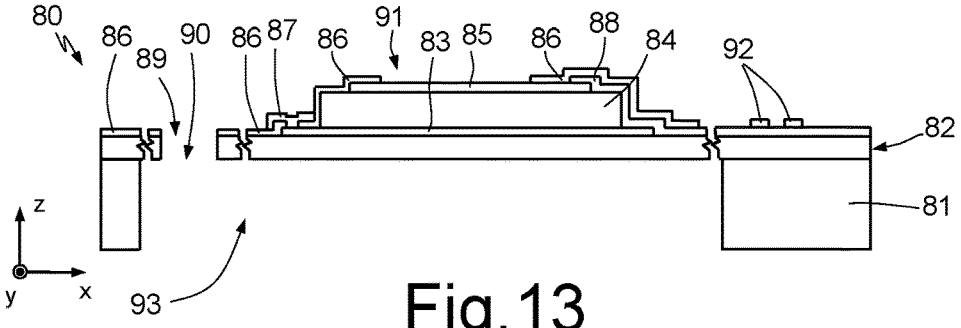

With reference to FIG. 13, a description is now given of manufacturing steps of an actuator element 80, here of piezoelectric type. The actuator element 80 is manufactured in a known manner. Briefly, a substrate 81 is provided (e.g., made of semiconductor material as silicon). However, the substrate 81 can be of a different material, like germanium, or any other suitable material. On this substrate 81, a layer of membrane 82, of flexible material, is formed. In further embodiments, the membrane can be formed from various types of materials typically used for MEMS devices, for example silicon dioxide ($SiO_2$) or silicon nitride (SiN), of a thickness, for example, between 0.5 and 10 μm, or it can be formed from a stack of silicon dioxide, silicon, silicon nitride ($SiO_2$—Si—SiN) in various combinations.

The process continues with the formation, on the membrane layer 82, of a lower electrode 83 (for example, made of a layer of titanium dioxide, $TiO_2$, with a thickness of between 5 and 50 nm, onto which is deposited a layer of platinum, Pt, with a thickness, e.g., of between 30 and 300 nm).

The process continues with the deposition of a piezoelectric layer over the lower electrode 83, depositing a layer of lead-zirconium-titanium trioxide (Pb—Zr—$TiO_3$, or PZT) having a thickness, for example, of between 0.5 and 3.0 μm (which, after subsequent shaping steps, will form the piezoelectric region 84); subsequently, a second layer of conductive material, e.g., platinum (Pt) or iridium (Ir) or iridium dioxide ($IrO_2$) or titanium-tungsten (TiW) or ruthenium (Ru), having a thickness, for example of between 30 and 300 nm, is deposited to form an upper electrode 85.

The electrode and piezoelectric layers undergo lithography and etching steps, to model them according to a desired pattern thus forming the lower electrode 83, the piezoelectric region 84 and the upper electrode 85. The set of these three elements constitutes a piezoelectric actuator.

One or more passivation layers 86 are deposited on the lower electrode 83, the piezoelectric region 84 and the upper electrode 85. The passivation layers include dielectric materials used for electrical insulation of the electrodes, for example, layers of silicon dioxide ($SiO_2$) or silicon nitride (SiN) or aluminum oxide ($Al_2O_3$), individually or in superimposed stacks, of a thickness, for example, between 10 nm and 1000 nm. The passivation layers are attached in correspondence to selective regions, to create access trenches to the lower electrode 83 and the upper electrode 85. The process continues with a step of deposition of conductive material, such as metal (e.g., aluminum, Al, or gold, Au, possibly together with barrier and adhesion layers such as titanium, Ti, titanium-tungsten, TiW, titanium nitride, TiN, tantalum, Ta, or tantalum nitride, TaN), inside the trenches thus created and over the passivation layers 86. A subsequent modelling step ("patterning") allows to form conductive tracks 87, 88 which enable selective access to the upper electrode 85 and the lower electrode 83, to polarize them electrically during use. It is also possible to form further passivation layers (e.g., of silicon dioxide, $SiO_2$, or silicon nitride, SiN) to protect the conductive tracks 87, 88. Conductive pads 92 are also formed laterally to the piezoelectric actuator, and are electrically coupled to the conductive tracks 87, 88.

The membrane 82 is selectively etched in correspondence to a region thereof which extends laterally, and at a distance, from the piezoelectric region 84, to expose a surface region of the underlying actuator substrate 81. A through hole 89 is thus formed through the membrane layer 82 which makes it possible, in later manufacturing steps, to generate a fluid connection with the access duct 48*a* and, via the latter, with cavity 41 in wafer 30.

Substrate 81 of the actuator element 80 is "etched" so as to form a cavity 93 on the opposite side with respect to the side which houses the actuator element 80. Through cavity 93, the layer of silicon dioxide which forms membrane 82, is exposed. This step allows to free membrane 82, making it suspended.

Figure 14:
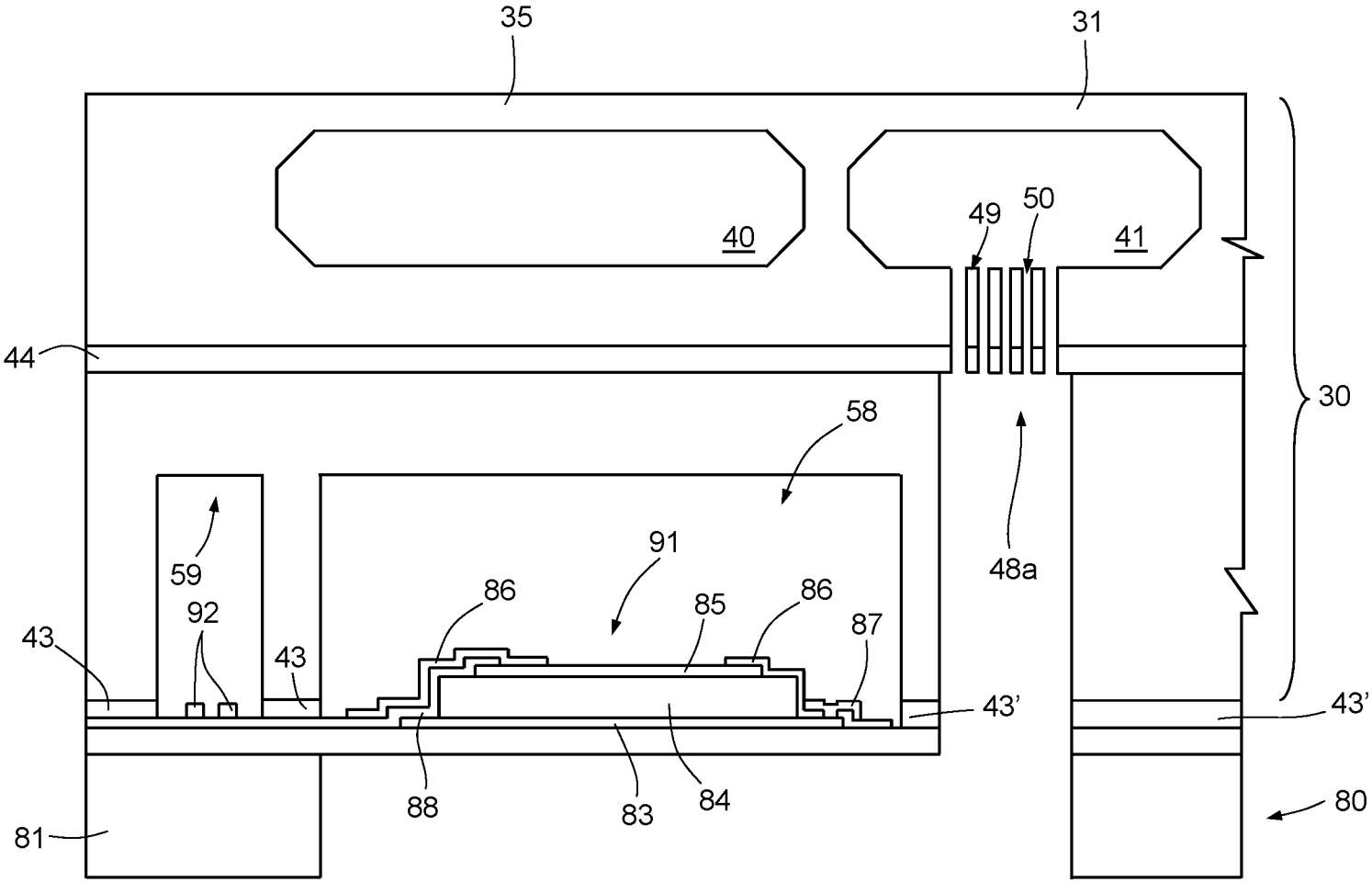

With reference to FIG. 14, the semiconductor wafer 30 and the actuator element 80 thus manufactured are coupled together (e.g., using the "wafer-to-wafer bonding" technique) in such a way that the housing 58 of the semiconductor wafer 30 completely contains the actuator element 80 and in such a way that the hole 89 made through the membrane 82 is aligned, and in fluidic connection, with the access duct 48*a* formed through the substrate 31 of the semiconductor wafer 30.

Figure 15:
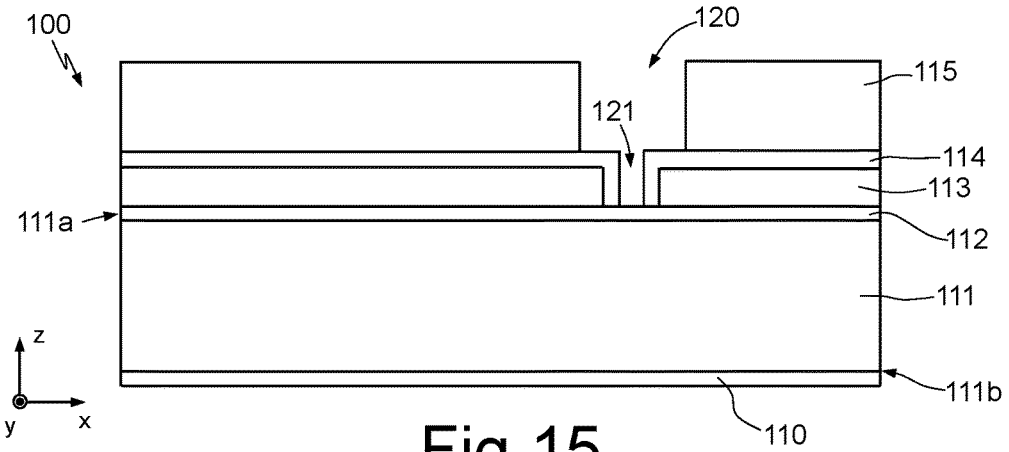

With reference to FIG. 15, processing steps are described for a wafer 100 for forming the outlet hole of the fluid ejection element. The processing steps provide, in brief, for arranging a substrate 111 of semiconductor material (for example, silicon). This substrate 111 has a first and a second surface 111*a*, 111*b*, which are subjected to a thermal oxidization process which leads to the formation of an anti-wetting layer 112 and a lower oxide layer 110.

On the surface of the anti-wetting layer 112 a first nozzle layer 113 is formed, for example of epitaxially grown polysilicon, having a thickness, for example, of between 10 and 75 μm.

The first nozzle layer 113 can be of a material other than polysilicon, for example it can be of silicon or another material, provided that it can be selectively removed with respect to the material of which the anti-wetting layer 112 is formed.

Therefore, by means of successive steps of lithography and etching, a nozzle hole 121 is formed through the first nozzle layer 113, until a surface region of the anti-wetting layer 112 is exposed.

The etching is carried out using a chemical etching capable of selectively removing the material of which the first nozzle layer 113 is made (here, polysilicon), but not the material of which the anti-wetting layer 112 is made (here, silicon dioxide, $SiO_2$). The etching profile for the first nozzle layer 113 can be controlled by choosing an etching technology and a chemical etching in order to achieve the desired result, such as, for example, dry-type etchings (RIE or DRIE) with semiconductor industry standard chemicals for etching silicon ($SF_6$, HBr etc.) to obtain a nozzle hole 121 with strongly vertical lateral walls.

In the subsequent steps of manufacturing, if necessary, both the first nozzle layer 113 and the nozzle hole 121 undergo a cleaning process, aimed at removing undesired polymeric layers which can be formed during the preceding etch step. This cleaning process is carried out by removing in oxidizing environments at high temperature (>250° C.) and/or in aggressive solvents.

A step of thermal oxidization of the outlet wafer 100, for example at a temperature of between 800° C. and 1100° C., is carried out, to form a layer of thermal oxide 114 over the first nozzle layer 113. This step has the function of allowing the formation of a thin layer of thermal oxide 114 with low surface roughness. Instead of using thermal oxidization, the above oxide can be deposited, wholly or in part, for example with CVD ("Chemical Vapor Deposition") techniques.

The thermal oxide layer 114 extends over the upper face of the outlet wafer 100 and inside the nozzle hole 121, covering its lateral walls. The thickness of the thermal oxide layer 114 is, for example, between 0.2 μm and 2 μm.

Above the thermal oxide layer 114 a second nozzle layer 115 is formed, for example in polysilicon. The second nozzle layer 115 has a final thickness, for example, of between 80 and 150 μm. The second nozzle layer 115 is, for example, epitaxially grown above the thermal oxide layer 114 and inside the nozzle hole 121, until it reaches a thickness greater than the desired thickness (for example about 3-5 μm greater); subsequently, it is subjected to a step of CMP ("Chemical Mechanical Polishing") to reduce its thickness and obtain an exposed upper surface with low roughness.

The process continues with the formation of a feed channel 120 for the nozzle and for removing the polysilicon which, in the previous step, filled the nozzle hole 121. To this end, use is made of masking and etching techniques which are known. The etching is carried out with a chemical etching that is suitable for removing the polysilicon of which the second nozzle layer 115 is formed, but not the silicon dioxide of the thermal oxide layer 114. The etching proceeds until the complete removal of the polysilicon, which extends inside the nozzle hole 121, is achieved, forming the feed channel 120 through the second nozzle layer 115 in fluid communication with the nozzle hole 121.

Figure 16:
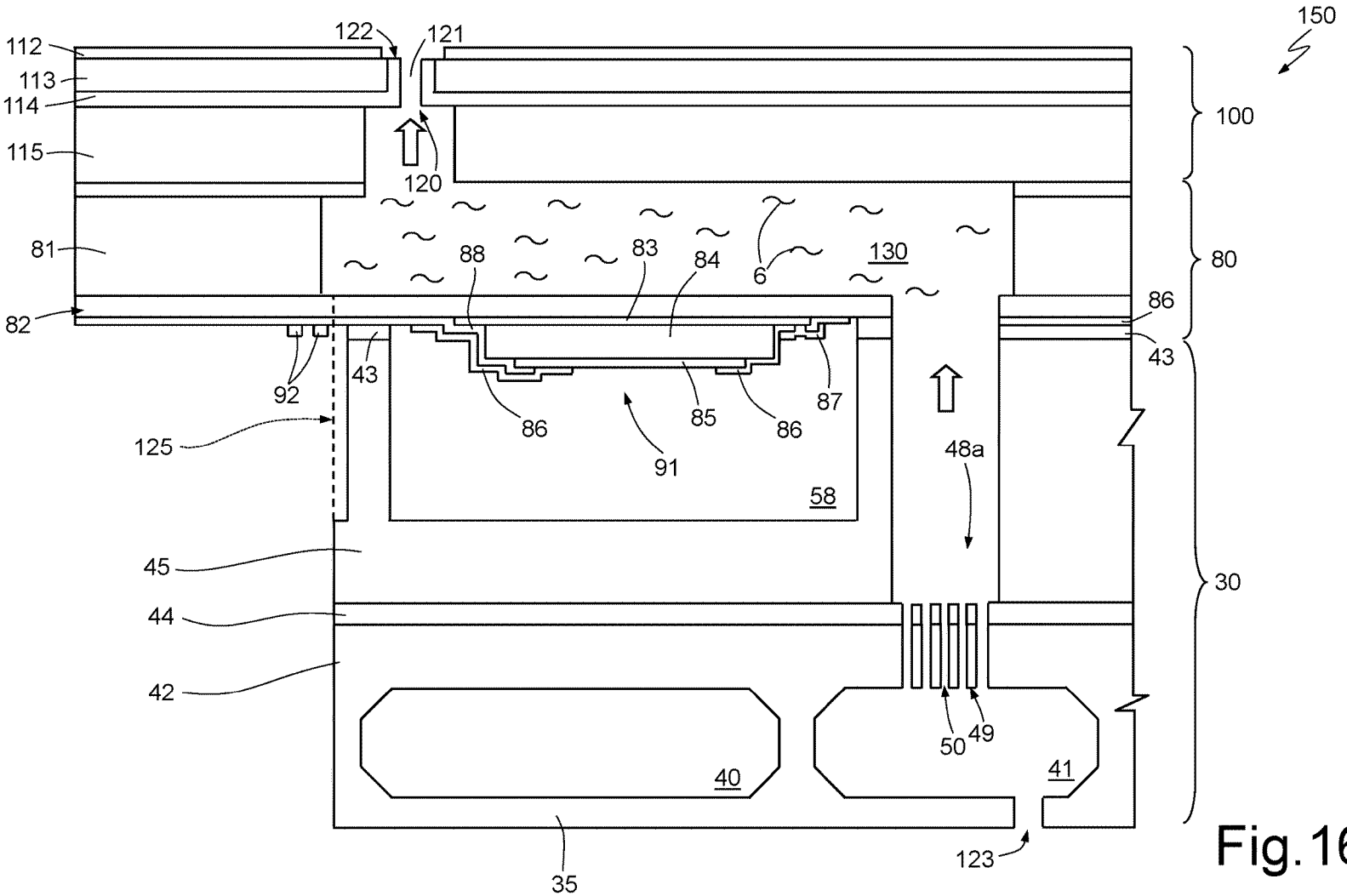

With reference to FIG. 16, the wafer 100, the actuator element 80 and the wafer 300 are coupled to each other by means of the "wafer-to-wafer bonding" technique using adhesive materials for the bonding, which may for example be polymeric or metallic or vitreous materials.

The process continues with processing steps the wafer 100, to complete the formation of a nozzle hole 121. To this end, the process continues with a removal step of the lower oxide layer 110 and the base layer 111. This step can be carried out by grinding the lower oxide layer 110 and part of the base layer 111, or by a chemical etching or by a combination of these two processes.

Following the process of grinding and/or chemical etching, in correspondence to the nozzle hole 121 and the upper surface of the first nozzle layer 113, the upper oxide layer 112 is removed, completing the formation of the nozzle. The removal is performed, for example, using a dry type etching, with a standard chemical etching for semiconductor technology.

According to one aspect of the present disclosure, layer 112 is removed above layer 113 in correspondence to the ink output nozzles.

The description given is valid, similarly, also in the event that on the upper oxide layer 112 there are also one or more anti-wetting layers. In this event, however, the removing step of the base layer 111 or the upper oxide layer 112 stops at the anti-wetting layer, which is not removed, or it is removed along the walls of the nozzle hole 121 if it is present there.

The processing of the wafer 30 is completed, by etching selective portions of the substrate 31 in correspondence to the cavity 41. In this way, cavity 41 is in fluidic communication with the exterior. Note that duct 48*a* extends along axis Z with an offset with respect to the inlet hole 123. In this way, cavity 41 collects part of the fluid 6 before it is introduced to duct 48*a*, cooperating with membrane 35 to reduce crosstalk. Cavity 41 performs, in part, the functions of the manifold according to the known art. In particular, cavity 41 has the function of containing the filtered particles; furthermore, it ensures fluidic continuity between the reservoir and duct 48*a*.

A step of partial cutting ("partial sawing") of the wafer, housing the actuator element 80, along the cutting line 125 shown in FIG. 16, makes it possible to remove an edge portion of said wafer in correspondence to the conductive pads 92, so as to make them accessible from the outside for a subsequent wire bonding operation.

In this way, the fluid ejector element 150 is obtained provided with attenuator and integrated filter in silicon.

Figure 17:
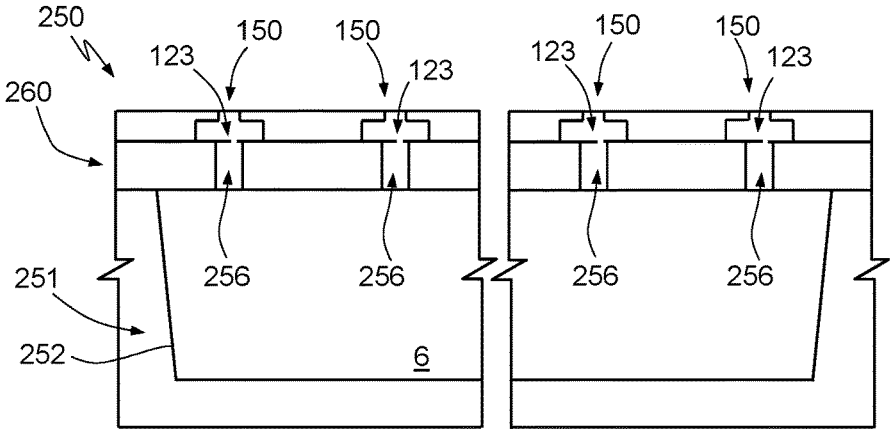
FIG. 17 shows a printhead comprising the ejection device of FIG. 16.

FIG. 17 schematically shows a printhead 250 comprising a plurality of fluid ejecting elements 150 formed as previously described.

The printhead 250 can be used not only for inkjet printing, but also for applications such as the high precision deposition of liquid solutions containing, for example, organic material, or generally in the sphere of depositing techniques of "inkjet printing" type, for the selective deposition of materials in a liquid state.

The printhead 250 furthermore comprises a reservoir 251, located below the fluid ejection elements 150, suitable for containing in its own internal housing 252 the fluid 6 (for example ink).

Between the reservoir 251 and the fluid ejection elements 150 there extends a manifold 260 having, as is known, the function of interface between the reservoir 251 and the fluid ejection elements 150. In particular, the manifold 260 includes a plurality of feed channels 256 which fluidly connect the reservoir 255 with a respective inlet hole 123 of the fluid ejection elements 150.

Figure 18:
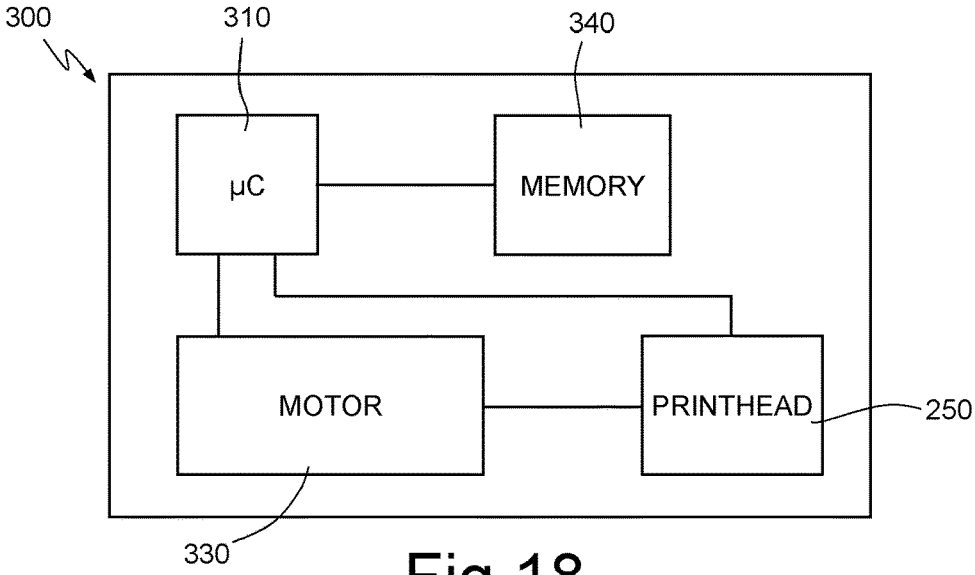
FIG. 18 shows a block diagram of a printer including the printhead shown in FIG. 17.

The printhead 250 can be incorporated into any printer 300 of known type, for example of the type shown schematically in FIG. 18.

The printer 300 of FIG. 18 comprises a microprocessor 310, a memory 320 connected to the microprocessor 310, a printhead 250 according to the present disclosure, and a motor 330 for moving the printhead 250. The microprocessor 310 is connected to the printhead 250 and to the motor 330, and it is configured for coordinating the movement of the printhead 250 (effected by operating the motor 330) and the ejection of the liquid (for example, ink) from the printhead 250. The operation of ejecting the liquid is effected by controlling the operation of the actuator 91 of each fluid ejection element 150.

In use, ejector element 150 operates according to the following steps.

In a first step, the chamber 130 is filled by the fluid 6 which it is desired to eject. This step of loading the fluid 6 is executed through the access duct 48*a*, which receives the fluid 6 via the feed channel 123, from the reservoir 251 through the cavity 41 and the filter element 49.

In a second step, the piezoelectric actuator 91 is controlled in such a way as to generate a deflection of the membrane 82 towards the inner part of chamber 130. This deflection causes a movement of the fluid 6 through the feed channel 120 and the nozzle hole 121 and generates the controlled expulsion of a drop of fluid 6 towards the outside of the ejector element.

In a third step, the piezoelectric actuator 91 is controlled in such a way as to generate a deflection of membrane 82 in the opposite direction from the preceding step, so as to increase the volume in the chamber 130, calling further fluid 6 towards the chamber 130 through the access duct 48*a*. The chamber 130, therefore, is recharged with fluid 6. It is possible to proceed cyclically by operating the piezoelectric actuator 91 to expel further drops of fluid. In practice, the second and the third step are repeated until the end of the printing process.

During the steps of loading the fluid 6 into the chamber 130 and expelling the fluid 6 through the nozzle hole 121, pressure waves in the fluid 6 are generated, which spread in the direction of the reservoir 251 and which, consequently, can interfere with the normal process of loading the fluid 6 into the chambers 130 of the ejection elements 150 belonging to the same printhead 250. According to the present disclosure, the membrane 35, having the function of integrated damper, operates as an absorption element for the pressure waves directed towards the inlet hole 123 of each ejection element 150. In fact, the membrane 35, suspended over the cavity 40, is arranged, in an embodiment of the present disclosure, at least in part upstream the access duct 48*a* and cavity 41 (in particular, coplanar to the inlet hole 123). More specifically, the membrane 35 extends laterally to the inlet hole 123 and cavity 41. In this way, the pressure waves directed towards the inlet hole 123 are damped before they enter the access duct 48*a*.

Thus for each individual fluid ejection element 150, a compensation effect for the pressure waves generated by the other ejection elements 150 belonging to the same printhead 250 is obtained, as well as a significant reduction in cross-talk.

From an examination of the characteristics of the disclosure achieved according to the present disclosure, the advantages that can be obtained from it are evident.

In particular, with reference to the first cavity 40 and to membrane 35, the integration of the dumping element into substrate 31 makes it possible to reduce manufacturing costs, prevent air leaks to the outside of the printing device and make the manufacturing process more accurate and faster.

Finally, it is clear that modifications and variants may be made to what is here described and illustrated without for this reason departing from the protective scope of the present disclosure.

Figure 19:
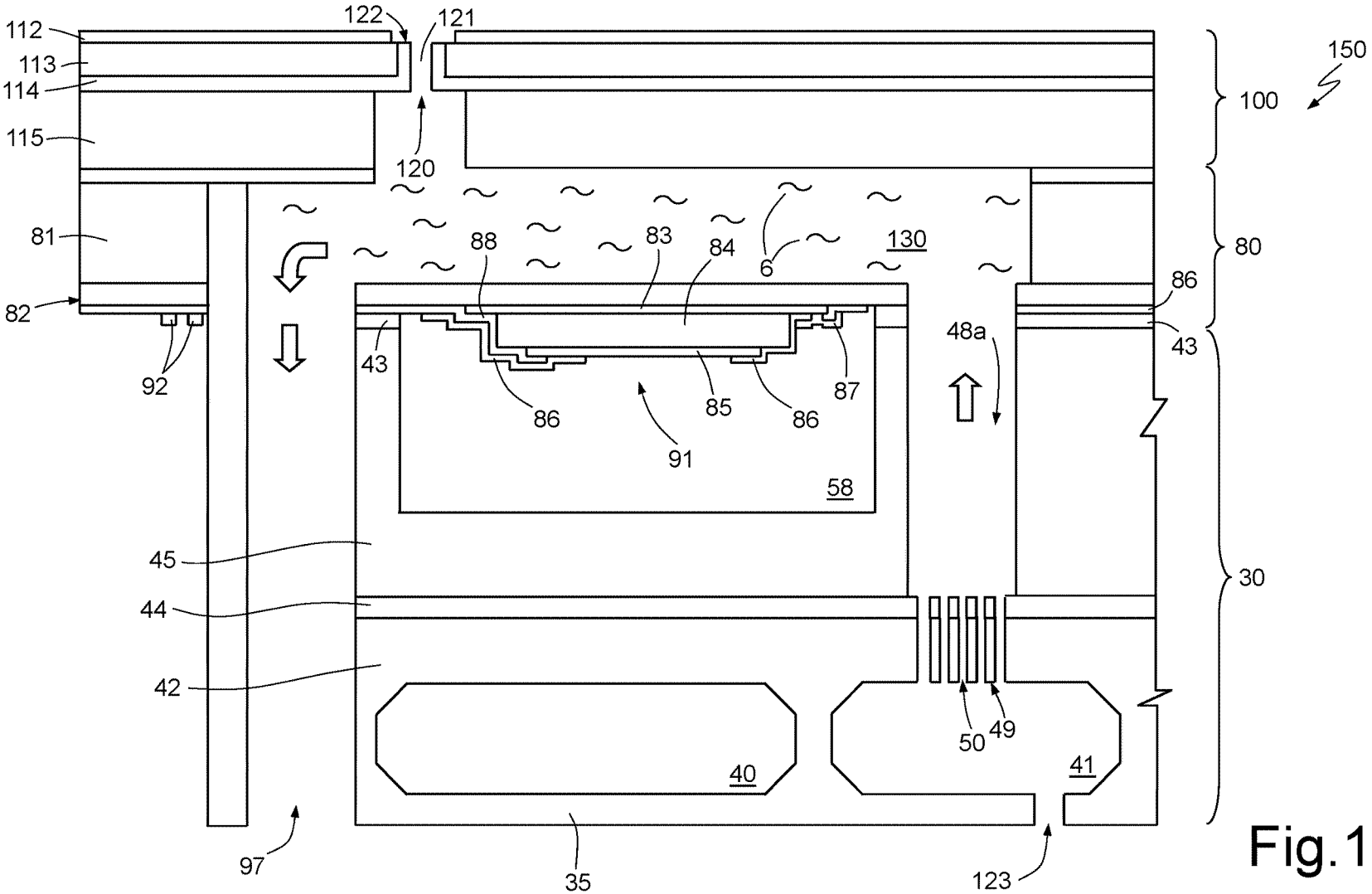
FIG. 19 shows a fluid ejection device according to a further embodiment of the present disclosure.

In particular, the embodiment of the fluid ejection element previously described and illustrated in the drawings comprises an inlet channel (made up of inlet hole 123, cavity 41 and duct 48*a*) which enable a flow of a liquid to be expelled which flows from reservoir 251, through manifold 260, towards the inner chamber 130. There is no expectation, in this case, for a recirculating channel to allow the fluid that has not been expelled from chamber 130 to return towards the manifold 260 and from here into the reservoir 251. FIG. 19 illustrates this further embodiment, in which there is a recirculating channel 97 which extends laterally to the cavity 40 in correspondence to a side of said cavity opposite to the side on which the inlet channel extends.

Furthermore, even if the present disclosure has been disclosed making explicit reference to various semiconductor bodies coupled to one another (e.g., wafers 30 and 100 and actuator element 80), it is anyway possible to process a single piece of solid material (e.g., semiconductor), integrating in it the fluid containing chamber 130, the actuator element 80, and the damper (i.e., the membrane 35 suspended over the cavity 40).

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An ejection device, comprising:

a body including:

a chamber configured to hold a fluid;

an ejection nozzle in fluidic communication with the chamber;

an actuator operatively coupled to the chamber to generate, in use, one or more pressure waves in the fluid to cause an ejection of the fluid from the ejection nozzle;

a fluidic path in fluidic communication with the chamber and configured to provide the fluid to the chamber; and a buried damping cavity and a damping membrane suspended over the damping cavity, the damping membrane being arranged, at least in part, upstream from the fluidic path and has a surface in fluid communication with the fluid before the fluid is provided to the fluidic path, wherein the body includes a first monolithic body that forms the buried damping cavity, the damping membrane, and at least a portion of the fluidic path.

2. The ejection device according to claim 1, wherein the first monolithic body includes an inlet hole fluidically coupled to the fluidic path, the damping membrane being arranged laterally to the inlet hole.

3. The ejection device according to claim 1, wherein the body includes a plurality of layers that form the chamber, the ejection nozzle, and the actuator.

4. The ejection device according to claim 3, wherein the body includes a duct that forms a remaining portion of the fluidic path.

5. The ejection device according to claim 1, wherein the damping membrane is located between the damping cavity and the surface in fluid communication with the fluid.

6. The ejection device according claim 1, wherein the damping membrane has a thickness between 0.5 μm and 50 μm.

7. The ejection device according to claim 1, comprising a filter integrated in the monolithic body and extending, at least in part, in the fluidic path.

8. The ejection device according to claim 7, wherein the filter has a lattice structure forming a plurality of apertures having sub-micrometric or micrometric dimensions.

9. The ejection device according to claim 7, wherein the monolithic body is made of glass, germanium, or silicon.

10. The ejection device according to claim 1, wherein the damping cavity is in fluid communication with an environment external to the ejection device and configured to receive an environmental pressure of the external environment.

11. The ejection device according to claim 1, wherein the actuator comprises an actuation membrane operatively coupled to the chamber and a piezoelectric element located on the actuation membrane, wherein the piezoelectric element is controllable so as to cause a movement of the actuation membrane at least one of: towards the chamber and away from the chamber.

12. A printhead, comprising:

a reservoir having a reservoir chamber configured to contain a fluid;

a plurality of ejection devices, each ejection device including a body including:

a chamber configured to hold a fluid;

an ejection nozzle in fluidic communication with the chamber;

an actuator operatively coupled to the chamber to generate, in use, one or more pressure waves in the fluid to cause an ejection of the fluid from the ejection nozzle;

a fluidic path in fluidic communication with the chamber and configured to provide the fluid to the chamber;

a buried damping cavity in fluid communication with the fluidic path and configured to provide the fluid to the fluidic path; and a damping membrane suspended over the damping cavity;

wherein the buried damping cavity and the damping membrane are formed in a monolithic body, and a manifold structure between the reservoir and the plurality of ejection devices, wherein the manifold structure is configured to place the reservoir in fluidic communication with the plurality of ejection devices.

13. A printer comprising the printhead according to claim 12.

14. A method for manufacturing an ejection device, comprising:

forming in a first body, a chamber configured to hold a fluid, an ejection nozzle in fluidic connection with the chamber, and an actuator operatively coupled to the chamber to generate, in use, one or more pressure waves in the fluid to cause an ejection of the fluid from the ejection nozzle;

forming, in the first body, a fluidic path in fluidic connection with the chamber configured to provide fluid to the chamber, and forming, in a monolithic body, a damping cavity, a damping membrane, and an inlet, wherein the damping membrane is suspended over the damping cavity, wherein the damping membrane is located upstream from the fluidic path and configured to provide fluid to the fluidic path; and coupling the monolithic body to the first body such that the inlet of the monolithic body is in fluid communication with the fluidic path of the first body.

15. The method according to claim 14, wherein the damping membrane is located laterally to the inlet.

16. The method according to claim 15, wherein forming the fluidic path includes forming a duct, in direct fluidic communication with the chamber.

17. The method according to claim 14, wherein the monolithic body is a semiconductor body, wherein forming the damping cavity comprises:

forming first trenches in a surface portion of a substrate of semiconductor material;

etching through the first trenches to form a first open area in the substrate below the first trenches and in fluidic communication with the first trenches;

growing, on the surface portion of the substrate, a first surface layer, forming, with the substrate, the second structural element and closing the trenches at the top; and heat treating the second structural element and forming the damping cavity buried in the second structural element.

18. The method according to claim 17, further comprising:

forming, above the first surface layer, an etching mask forming a lattice structure;

forming a second surface layer above the etching mask; and etching, at said lattice structure, selective portions of the second surface layer and of the first surface layer not protected by the etching mask and forming part of the fluidic path and a filter integrated in the second structural element and in the fluidic path.

19. The method according to claim 18, wherein the filter is formed from a remaining portion of the first surface layer covered by the etching mask.

20. The method according to claim 18, wherein the filter and the damping membrane are formed, at least in part, of a same material, including one of: glass, germanium, and silicon.

* * * * *